US009791799B2

(12) United States Patent
Kobayashi

(10) Patent No.: US 9,791,799 B2
(45) Date of Patent: Oct. 17, 2017

(54) IMAGE FORMING APPARATUS WITH DEVELOPING BIAS VOLTAGE

(71) Applicant: KYOCERA Document Solutions Inc., Osaka-shi, Osaka (JP)

(72) Inventor: Kiyotaka Kobayashi, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/139,278

(22) Filed: Apr. 26, 2016

(65) Prior Publication Data

US 2016/0313666 A1 Oct. 27, 2016

(30) Foreign Application Priority Data

Apr. 27, 2015 (JP) ..... 2015-090095

(51) Int. Cl.
*G03G 15/02* (2006.01)

(52) U.S. Cl.
CPC . *G03G 15/0225* (2013.01); *G03G 2215/0132* (2013.01); *G03G 2215/0193* (2013.01)

(58) Field of Classification Search
CPC ..... G03G 15/065; G03G 15/0225
USPC ..... 399/55
See application file for complete search history.

(56) References Cited

U.S. PATENT DOCUMENTS 5,521,683 A * 5/1996 Miyamoto ..... G03G 15/065 399/55
5,873,019 A * 2/1999 Mizuishi ..... G03G 15/0225 361/225
9,223,247 B2 * 12/2015 Mugita ..... G03G 15/065
2006/0098999 A1 * 5/2006 Nishida ..... G03G 15/065 399/55

FOREIGN PATENT DOCUMENTS

JP 2006047397 A 2/2006

* cited by examiner

*Primary Examiner* — Quana M Grainger
(74) *Attorney, Agent, or Firm* — Alleman Hall Creasman & Tuttle LLP

(57) ABSTRACT

An image forming apparatus includes a charging roller and a developing voltage application portion. The charging roller is in contact with a rotating image carrier to charge the image carrier. The developing voltage application portion applies a developing bias voltage including an AC component to a developing roller in a developing portion, when the image carrier is in a rotation state with no image. The rotation state with no image indicates a state in which the charged image carrier rotates with no electrostatic latent image being formed thereon. The developing portion supplies toner containing an external additive to the image carrier.

3 Claims, 6 Drawing Sheets

IMAGE FORMING APPARATUS WITH DEVELOPING BIAS VOLTAGE

INCORPORATION BY REFERENCE

This application is based upon and claims the benefit of priority from the corresponding Japanese Patent Application No. 2015-090095 filed on Apr. 27, 2015, the entire contents of which are incorporated herein by reference.

BACKGROUND

The present disclosure relates to an electrophotographic image forming apparatus.

A charging portion of a contact charging system for charging an image carrier has been known in an electrophotographic image forming apparatus. In the charging portion of a contact charging system, a charging roller to which a charging bias voltage is applied rotates while being in contact with the surface of the image carrier, thereby charging the image carrier.

The image forming apparatus may use toner, which includes toner particles and an external additive adhered around the toner particles, for visualizing an electrostatic latent image on the surface of the image carrier. In this case, the external additive having low electric resistance may remain on the surface of the image carrier without being transferred to a transfer target member, such as a sheet material or an intermediate transfer belt.

When the external additive remaining on the image carrier slip through a cleaning portion to move to a charging position of the image carrier and are non-uniformly deposited on the charging roller, image quality is likely to be deteriorated, such as occurrence of density unevenness of an image.

There has also been known that a toner band including the external additive is formed on the image carrier, and a bias voltage is applied to the charging roller, when the region of the toner band on the image carrier faces the charging roller after the transfer of the toner particles to the transfer roller. According to this, the external additive is uniformly deposited onto the surface of the charging roller along the direction of the rotation axis thereof, whereby deterioration in image quality caused by the external additive remaining on the image carrier can be avoided.

SUMMARY

An image forming apparatus according to one aspect of the present disclosure includes a charging roller and a developing voltage application portion. The charging roller is a member which is in contact with a rotating image carrier to charge the image carrier. The developing voltage application portion applies a developing bias voltage including an AC component to a developing roller in a developing portion, when the image carrier is in a rotation state with no image. The rotation state with no image indicates a state in which the charged image carrier rotates with no electrostatic latent image being formed thereon. The developing portion supplies toner containing an external additive to the image carrier.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of the present disclosure will be described based on the accompanying drawings. Note that the embodiments described below are only an example embodying the present disclosure, and does not have nature to limit the technical scope of the present disclosure.

First Embodiment: Configuration of Image Forming Apparatus 10

Firstly, the configuration of an image forming apparatus 10 according to the first embodiment will be described with reference to FIGS. 1 and 2. The image forming apparatus 10 is an electrophotographic image forming apparatus. In the example illustrated in FIG. 1, the image forming apparatus 10 is a tandem color image forming apparatus. Other examples of the image forming apparatus 10 include a color copying machine, a color facsimile apparatus, and a multifunction peripheral having an image forming function and a document scanning function for reading a document image.

Figure 1:
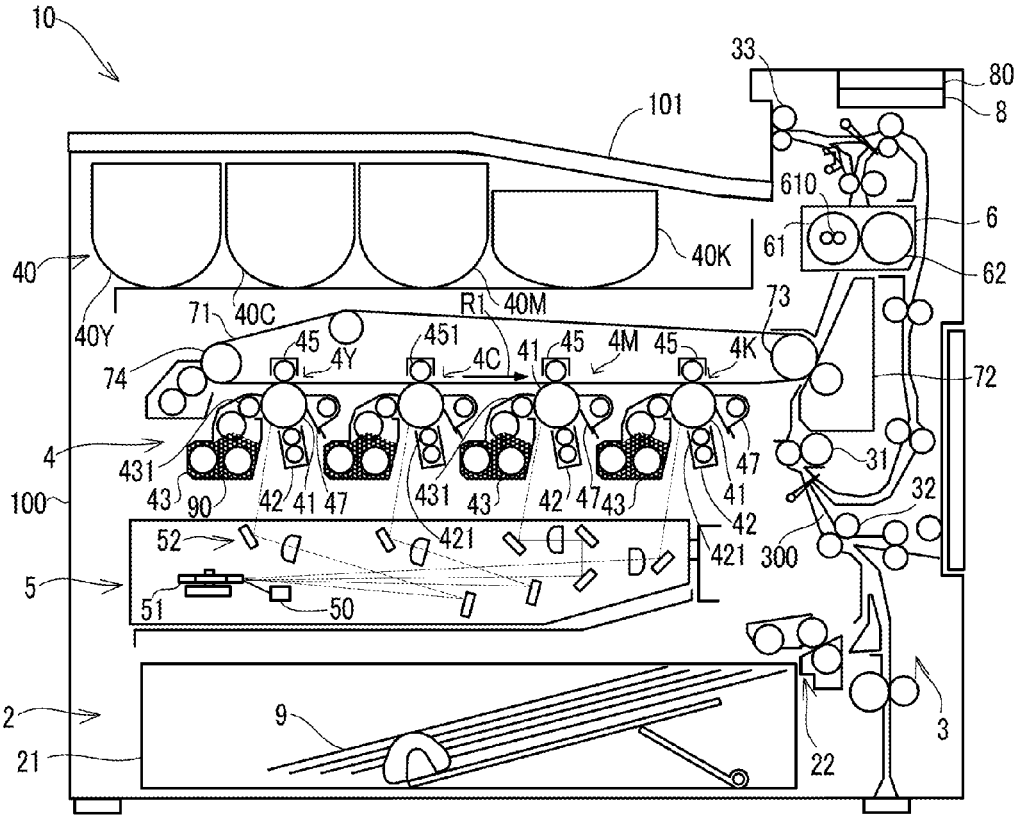
FIG. 1 is a view illustrating the configuration of an image forming apparatus according to a first embodiment.

As illustrated in FIG. 1, the image forming apparatus 10 includes, in a housing 100, a sheet feed portion 2, a sheet conveying portion 3, a toner supply portion 40, an image forming portion 4, an optical scanning portion 5, a fixing portion 6, an intermediate transfer belt 71, a secondary transfer portion 72, an operation display portion 80, a control portion 8, and the like.

The sheet feed portion 2 includes a sheet receiving portion 21 on which a sheet material 9 is placed and a sheet sending portion 22 that sends the sheet material 9 on the sheet receiving portion 21 to a sheet conveyance path 300 communicating with the image forming portion 4. The sheet material 9 is sheet-like image forming medium such as papers, coat papers, postcards, envelopes, or OHP sheets.

The sheet conveying portion 3 includes a registration roller 31, a conveyance roller 32, a discharge roller, and the like. The registration roller 31 and the conveyance roller 32 convey the sheet material 9 along the sheet conveyance path 300. Further, the discharge roller 33 discharges the sheet material 9, on which an image is formed on the sheet conveyance path 300, onto a discharge tray 101 from a discharge opening of the sheet conveyance path 300.

The toner supply portion 40 supplies toner 90 for development to the image forming portion 4, and the image forming portion 4 transfers an image of the toner 90 onto the intermediate transfer belt 71. The toner 90 includes toner particles containing pigment as a main component and an external additive adhered around the toner particles. For example, it is conceivable that the external additive is titanium oxide particles, silica particles, or the like.

The toner supply portion 40 and the image forming portion 4 are provided for each color of the toner 90. Reference symbols Y, C, M, and K in the drawings respectively indicate the corresponding color (yellow, cyan, magenta, and black) of the toner 90. The toner 90 of each color is supplied to a developing portion 43 mounted to each of the image forming portions 4 from each of the toner supply portions 40 detachably mounted to the housing 100.

Each of the four image forming portions 4 provided for each color of the toner 90 is disposed at the position along the endless intermediate transfer belt 71 which rotates. The image forming portions 4 respectively form images (toner images) of different colors on the surface of the intermediate transfer belt 71, which rotates, such that the images are superimposed on one another.

Each of the image forming portions 4 includes a drum type photosensitive member 41, a charging portion 42, a developing portion 43, a primary transfer portion 45, a primary cleaning portion 47, and the like. The photosensitive member 41 is one example of an image carrier.

The intermediate transfer belt 71 is a looped endless belt member. The intermediate transfer belt 71 rotates in a state of being extended on and between a first support roller 73 and a second support roller 74. The intermediate transfer belt 71 is one example of a transfer target member on which an image of the toner 90 is transferred from the photosensitive member 41.

In each of the image forming portions 4, the photosensitive member 41 rotates at a circumferential speed according to the moving speed of the intermediate transfer belt 71, and the charging portion 42 uniformly charges the surface of the photosensitive member 41.

The charging portion 42 includes a charging roller 421 that is brought into contact with the rotating photosensitive member 41 to charge the same. An outer layer portion, of the charging roller 421, that is in contact with the photosensitive member 41 is a conductive or semiconductive rubber member.

In addition, the optical scanning portion 5 having a light source 50 such as a semiconductor laser, a scanning mirror 51 such as a polygon mirror, and other optical devices 52 forms an electrostatic latent image on the surface of the charged photosensitive member 41 by scanning of emission light from the light source 50. Further, the developing portion 43 supplies the toner 90 to the photosensitive member 41 to develop the electrostatic latent image into a toner image. Notably, the optical scanning portion 5 is generally referred to as a laser scanning unit (LSU).

The developing portion 43 includes a developing roller 431 which rotates while facing the photosensitive member 41, and the toner 90 is supplied from the developing roller 431 to the photosensitive member 41.

During the image formation, the primary transfer portion 45 transfers the toner image carried on the photosensitive member 41 onto the surface of the intermediate transfer belt 71. The primary transfer portion 45 includes a primary transfer roller 451 that rotates while nipping the intermediate transfer belt 71 with the photosensitive member 41.

Further, the primary cleaning portion 47 cleans the surface of the photosensitive member 41 by removing the residual toner 90 on the surface of the photosensitive member 41.

It is to be noted that each of the image forming portions 4 may include an electricity removing portion that outputs electricity removing light for removing electricity from the photosensitive member 41. For example, the electricity removing light is emitted to the photosensitive member 41 at the position between the primary transfer portion 45 and the primary cleaning portion 47. In addition, the electricity removing light may be emitted to the photosensitive member 41 at the position between the developing portion 43 and the primary transfer portion 45.

In the present embodiment, a black image forming portion 4K, a magenta image forming portion 4M, a cyan image forming portion 4C, and a yellow image forming portion 4Y are sequentially disposed in order from the downstream side to the upstream side in the rotating direction R1 of the intermediate transfer belt 71.

The secondary transfer portion 72 transfers the toner image, which has been transferred onto the surface of the intermediate transfer belt 71, onto the sheet material 9 that is now moving on the sheet conveyance path 300.

The fixing portion 6 nips the sheet material 9, on which the toner image is formed, between a fixing roller 61 including a heater 610 and a pressure roller 62, and sends the sheet material 9 to a next process. Thus, the fixing portion 6 heats the toner image on the sheet material 9 to fix an image onto the sheet material 9.

The control portion 8 displays an operation menu or the like on the operation display portion 80, and controls electronic devices in the image forming apparatus 10 based on input information input through the operation display portion 80 and detection information by various sensors not illustrated.

Figure 2:
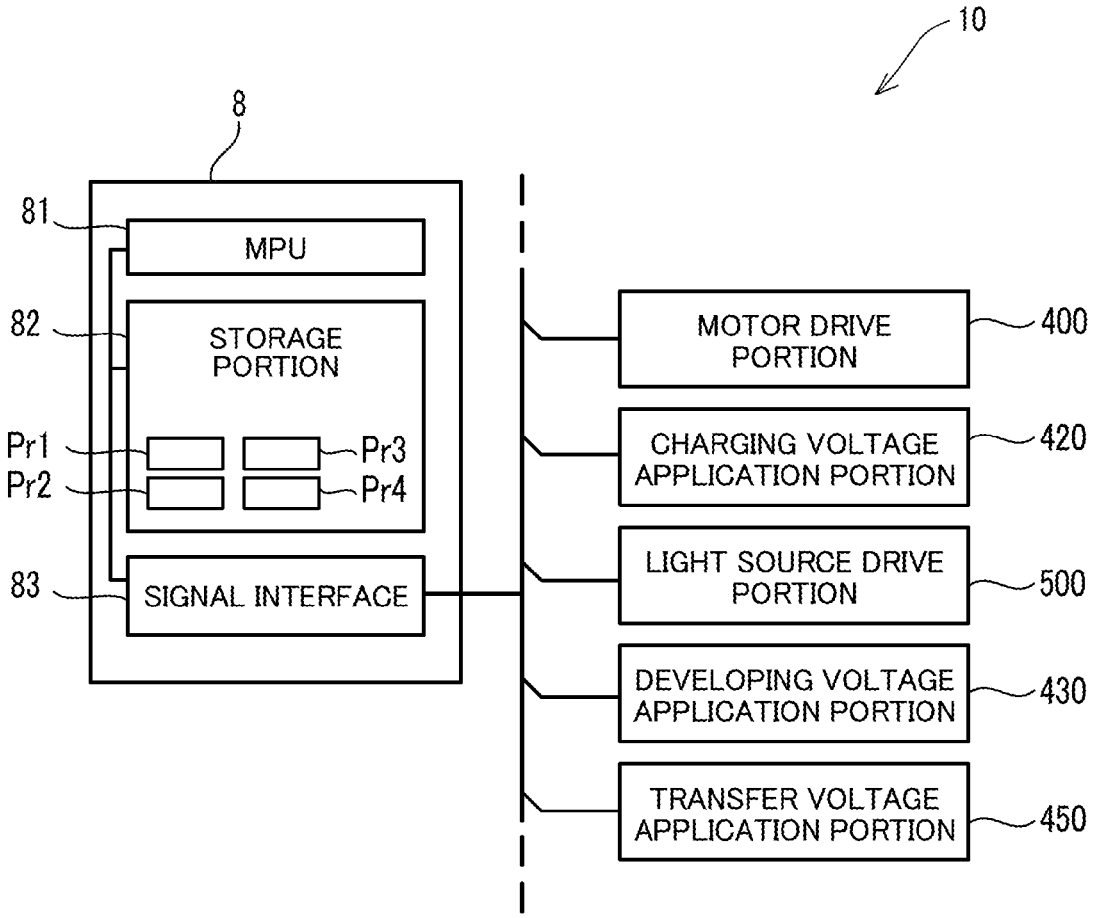
FIG. 2 is a block diagram illustrating control-related portions in the image forming apparatus according to the first embodiment.

As illustrated in FIG. 2, the image forming apparatus 10 also includes a motor drive portion 400, a charging voltage application portion 420, a light source drive portion 500, a developing voltage application portion 430, and a transfer voltage application portion 450.

The motor drive portion 400 is a circuit that outputs and controls drive power supplied to an unillustrated motor which is a drive source for rotating a rotating member such as the photosensitive member 41, the charging roller 421, the developing roller 431, the primary transfer roller 451, and the first support roller 73.

The charging voltage application portion 420 is a circuit that applies a charging bias voltage, which is a voltage for charging the photosensitive member 41, to the charging roller 421. The charging bias voltage is a bias voltage that allows the surface potential of the photosensitive member 41 to be charged to a potential having the same polarity as the charging polarity of the toner 90.

For example, it is conceivable that the charging bias voltage is a DC bias voltage. It is also conceivable that the charging bias voltage is a bias voltage including a DC component and an AC component, that is, a bias voltage in which a DC voltage and an AC voltage are superimposed on each other.

The light source drive portion 500 is a circuit that outputs and controls light-emission power which is supplied to the light source 50 in the optical scanning portion 5.

The developing voltage application portion 430 is a circuit that applies a developing bias voltage to the developing roller 431 in the developing portion 43. The developing bias voltage is a bias voltage that transfers the toner 90 on the developing roller 431 to the portion of the electrostatic latent image on the surface of the photosensitive member 41.

The developing bias voltage is a bias voltage including a DC component and an AC component, that is, a bias voltage in which a DC voltage and an AC voltage are superimposed on each other. According to this, the toner 90 reciprocates between the developing roller 431 and the photosensitive member 41 at the position, on the surface of the developing roller 431, that is opposed to the photosensitive member 41.

The DC component of the developing bias voltage based on potential in the region other than the electrostatic latent image on the surface of the photosensitive member 41 is a voltage with a polarity opposite to the charging polarity of the toner 90. On the other hand, the DC component of the developing bias voltage based on the potential of the electrostatic latent image on the surface of the photosensitive member 41 is a voltage having the same polarity as the charging polarity of the toner 90. According to this, the toner 90 charged due to friction charging selectively transfers to the portion of the electrostatic latent image on the surface of the photosensitive member 41.

The transfer voltage application portion 450 is a circuit that applies a bias voltage to the primary transfer roller 451 of the primary transfer portion 45. The transfer bias voltage applied to the primary transfer roller 451 during the image formation is a bias voltage with a polarity opposite to the charging polarity of the toner 90 based on the surface potential of the photosensitive member 41. According to this, the toner image on the surface of the photosensitive member 41 transfers to the intermediate transfer belt 71.

As illustrated in FIG. 2, the control portion 8 includes an MPU (microprocessor unit) 81, a storage portion 82, a signal interface 83, and the like.

The MPU 81 is a processor that executes various computing processes. The storage portion 82 is a non-volatile storage portion that previously stores a control program to cause the MPU 81 to execute various processes and other information. The storage portion 82 is also an information storage medium from and to which various information can be read and written by the MPU 81.

The signal interface 83 is an interface circuit that relays signal communication between the MPU 81, and sensors and a device to be controlled. The MPU 81 inputs detection signals (measurement signals) from various sensors through the signal interface 83. The MPU 81 also outputs a control signal through the signal interface 83.

In the present embodiment, the MPU 81 outputs the control signal to each of the motor drive portion 400, the charging voltage application portion 420, the light source drive portion 500, the developing voltage application portion 430, and the transfer voltage application portion 450 through the signal interface 83. The control portion 8 comprehensively controls the image forming apparatus 10 through the execution of the various control programs previously stored in the storage portion 82 by the MPU 81.

In the image forming apparatus 10, the external additive having low electric resistance may remain on the surface of the photosensitive member 41 without being transferred to the intermediate transfer belt 71.

When the external additive remaining on the photosensitive member 41 moves to the charging position of the photosensitive member 41 by slipping through the primary cleaning portion 47, and is non-uniformly deposited onto the charging roller 421, deterioration in image quality such as density unevenness is likely to occur in an image.

Meanwhile, it is conceivable that a toner band including the external additive is formed on the photosensitive member 41, and a bias voltage is applied to the charging roller 421 in order to uniformly deposit the external additive onto the surface of the charging roller 421 along the direction of the rotation axis thereof.

However, it is desirable that deterioration in image quality caused by the external additive remaining on the photosensitive member 41 can be prevented with consumption of toner 90 being suppressed.

The present embodiment can prevent deterioration in image quality caused by the external additive remaining on the photosensitive member 41, while suppressing consumption of toner 90 containing the external additive. The detail thereof will be described below.

External Additive Coating Process (First Embodiment)

The control portion 8 in the image forming apparatus 10 executes an external additive coating process. The external additive coating process is a process for uniformly coating the surface of the charging roller 421 with the external additive in the toner 90. The external additive coating process is performed for the image forming portion 4 of each color.

The external additive coating process is executed when image formation is not performed. For example, the control portion 8 executes the external additive coating process until the first image formation is performed after the toner 90 is supplied to the developing portion 43 from the toner supply portion 40.

The toner supply portion 40 supplies the toner 90 to the developing portion 43, when the following supply conditions are established, for example. The first supply condition is that an operation of starting a toner installing process has been performed to the operation display portion 80.

The toner installing process is executed before the image forming apparatus 10 is used for the first time or when a unit of the developing portion 43 is exchanged.

The second supply condition is that the toner supply portion 40 has been exchanged. For example, it is conceivable that the image forming apparatus 10 includes an identification information reading portion that reads identification information of the toner supply portion 40 from an information storage medium, such as an RF tag, attached to the toner supply portion 40. In this case, the control portion 8 can detect that the toner supply portion 40 has been exchanged in accordance with the change in the identification information acquired through the identification information reading portion.

It is also conceivable that the image forming apparatus 10 has one or both of a toner amount sensor that detects an amount of toner 90 remaining in the toner supply portion 40 and a supply portion detection sensor that detects whether or not the toner supply portion 40 is mounted. In this case, the control portion 8 can detect that the toner supply portion 40 has been exchanged in accordance with the change in the detection result from one or both of the toner amount sensor and the supply portion detection sensor.

It is also conceivable that the control portion 8 detects that the toner supply portion 40 has been exchanged, when an operation indicating that the toner supply portion 40 has been exchanged is performed to the operation display portion 80.

The third supply condition is that image formation has been performed with a printing rate exceeding a predetermined threshold value. In this case, the toner 90 is supplied to the developing portion 43 in order to replenish the consumed toner 90.

The fourth supply condition is that the toner amount sensor has detected an amount less than a predetermined lower limit amount.

Next, one example of a procedure of the external additive coating process executed by the control portion 8 will be described with reference to the flowchart illustrated in FIG. 3. In the description below, S101, S102 . . . , each indicate an identification reference symbol for each step executed by the control portion 8.

<Step S101>

In the external additive coating process, the control portion 8 rotates the motor through the motor drive portion 400. According to this, the photosensitive member 41, the charging roller 421, the developing roller 431, the intermediate transfer belt 71, and the primary transfer roller 451 rotate.

With the execution of a motor control program Pr1 by the MPU 81, the process in step S101 by the control portion 8 is implemented.

<Step S102>

The control portion 8 also applies a charging bias voltage Vc to the charging roller 421 through the charging voltage application portion 420. According to this, the photosensitive member 41 rotates in a charged state.

With the execution of a charging voltage control program Pr2 by the MPU 81, the process of step S102 by the control portion 8 is implemented.

For example, it is conceivable that the charging bias voltage Vc applied in the external additive coating process is a bias voltage including a DC component and an AC component, that is, a bias voltage in which a DC voltage and an AC voltage are superimposed on each other.

During the external additive coating process, light emission to the photosensitive member 41 by the optical scanning portion 5 is not performed. That is, the electrostatic latent image is not formed on the photosensitive member 41 during the external additive coating process. In the description below, the state in which the photosensitive member 41 charged by the application of charges from the charging roller 421 rotates with the electrostatic latent image being not formed thereon is referred to as a rotation state with no image.

<Step S103>

When the charged photosensitive member 41 is in the rotation state with no image, the control portion 8 applies a developing bias voltage Vd1 including an AC component to the developing roller 431 of the developing portion 43 through the developing voltage application portion 430. Specifically, the developing voltage application portion 430 applies the developing bias voltage Vd1 including an AC component to the developing roller 431 according to the control signal from the control portion 8.

With the execution of a developing voltage control program Pr3 by the MPU 81, the process in step S103 by the control portion 8 is implemented.

For example, it is conceivable that the developing bias voltage Vd1 at the time at which the charged photosensitive member 41 is in the rotation state with no image has a peak-to-peak value larger than a reference developing bias voltage Vd0 applied to the developing roller 431 during the image formation.

Further, the DC component in the developing bias voltage Vd1 based on the surface potential of the photosensitive member 41 is a voltage with a polarity opposite to the charging polarity of the toner 90, as in the DC component in the reference developing bias voltage Vd0.

The charging polarity of the toner 90 is the same as the charging polarity of the toner particle having a large charging amount. On the other hand, some of the external additive having a small charging amount has a polarity opposite to the charging polarity of the toner particle. Further, since the particle of the external additive is extremely smaller than the particle of the toner 90, it has high adhesion force to the photosensitive member 41. Therefore, most of the toner particles in the toner 90 are collected by the developing roller 431 without transferring to the photosensitive member 41, and the external additive is easy to transfer to the surface of the photosensitive member 41. In addition, the external additive having transferred to the surface of the photosensitive member 41 is less likely to be separated from the surface of the photosensitive member 41 even when the external additive receives an action of an electric field.

Also, discharge products are generated by the AC component in the charging bias voltage Vc. In the case where the peak-to-peak value of the AC component is large, more discharge products are generated. Due to the action of the discharge products, more of the external additive is likely to be deposited on the surface of the photosensitive member 41 at the position of the developing roller 431. This results in ensuring the amount of the external additive that slips through a cleaning blade of the primary cleaning portion 47 to reach the charging roller 421.

In addition, with the application of the developing bias voltage Vd1 having a large peak-to-peak value to the developing roller 431, more of the toner 90 than that during the image formation reciprocates between the developing roller 431 and the photosensitive member 41. Consequently, more of the external additive transfers to the surface of the photosensitive member 41.

With the configuration described above, the external additive is deposited onto the surface of the photosensitive member 41 at the positon where the photosensitive member 41 and the developing roller 431 face each other, whereby a uniform layer of the external additive is formed on the photosensitive member 41 along the direction of the rotation axis of the photosensitive member 41.

<Step S104>

Further, in the case where the charged photosensitive member 41 is in the rotation state with no image, the control portion 8 applies an inverse transfer bias voltage Vt1, which has a polarity opposite to the polarity of the transfer bias voltage Vt0 applied to transfer the toner image, to the primary transfer roller 451 through the transfer voltage application portion 450. Specifically, the transfer voltage application portion 450 applies the inverse transfer bias voltage Vt1 to the primary transfer roller 451 according to the control signal from the control portion 8.

With the execution of a transfer voltage control program Pr4 by the MPU 81, the process in step S104 by the control portion 8 is implemented.

The application of the inverse transfer bias voltage Vt1 to the primary transfer roller 451 can prevent the external additive deposited on the photosensitive member 41 from transferring to the intermediate transfer belt 71. It is to be noted that the external additive charged to the same polarity as the polarity of the toner 90 is less likely to be separated from the surface of the photosensitive member 41 due to the action of the inverse transfer bias voltage Vt1. On the other hand, silica or the like used as the external additive is charged to a polarity opposite to the polarity of the toner 90. The silica has a high resistance value, and thus, is unsuitable for coating the charging roller 421. The inverse transfer bias voltage Vt1 functions to collect the silica or the like, which is unsuitable for coating the charging roller 421, to the intermediate transfer belt 71.

Further, the external additive has a small particle diameter, and is deposited onto the surface of the photosensitive member 41 as being separated from the toner particle having a large particle diameter. Therefore, the external additive deposited onto the photosensitive member 41 slips through the cleaning blade of the primary cleaning portion 47 to reach the position of the charging roller 421.

Further, the layer of the external additive uniformly formed on the surface of the photosensitive member 41 is brought into contact with the charging roller 421, whereby the uniform layer of the external additive is formed on the surface of the charging roller 421 along the direction of the rotation axis of the charging roller 421.

<Step S105>

The control portion 8 continues the rotation state with no image of the photosensitive member 41 and the application of the charging bias voltage Vc, the developing bias voltage Vd1, and the inverse transfer bias voltage Vt1, until the photosensitive member 41 rotates a predetermined number of times.

<Step S106>

After the photosensitive member 41 rotates a predetermined number of times, the control portion 8 stops the application of the charging bias voltage Vc, the developing bias voltage Vd1, and the inverse transfer bias voltage Vt1.

With the execution of the charging voltage control program Pr2, the developing voltage control program Pr3, and the transfer voltage control program Pr4 by the MPU 81, the process in step S106 by the control portion 8 is implemented.

<Step S107>

Further, the control portion 8 stops the motor through the motor drive portion 400. According to this, the rotations of the photosensitive member 41, the charging roller 421, the developing roller 431, the intermediate transfer belt 71, and the primary transfer roller 451 are stopped. Thus, the external additive coating process is ended.

With the execution of the motor control program Pr1 by the MPU 81, the processes in steps S105 and S107 by the control portion 8 are implemented.

As described above, during the external additive coating process, the developing voltage application portion 430 applies the developing bias voltage Vd1 to the developing roller 431 when the photosensitive member 41 is in the rotation state with no image (S103). According to this, the external additive in the toner 90 is non-uniformly deposited onto the surface of the charging roller 421 along the direction of the rotation axis thereof.

Even when the charging roller 421 is in contact with the surface of the photosensitive member 41 on which the external additive remains during the image formation after the external additive is non-uniformly deposited onto the surface of the charging roller 421, the state in which the external additive is uniformly deposited onto the surface of the charging roller 421 is maintained.

In addition, during the external additive coating process, only a slight amount of the external additive that is to be deposited onto the charging roller 421 is used, whereby unnecessary consumption of the toner 90 collected in the primary cleaning portion 47 hardly occurs.

Therefore, the image forming apparatus 10 can prevent deterioration in image quality caused by the external additive remaining on the photosensitive member 41, while suppressing consumption of toner 90 containing the external additive.

Further, it is desirable that the external additive coating process is executed until the first image formation is performed after the toner 90 is supplied to the developing portion 43 from the toner supply portion 40. According to this, a uniform layer of the external additive is formed on the surface of the charging roller 421 before the image forming process, which can more reliably prevent the external additive remaining on the photosensitive member 41 from adversely affecting image quality.

It is to be noted that, as described above, during the external additive coating process, the developing voltage application portion 430 applies the developing bias voltage Vd1 to the developing roller 431 when the photosensitive member 41 is in the rotation state with no image (S103).

Further, in many cases, the charging roller 421 is brand-new under the condition in which the toner installing process is performed. When the image forming process is performed in the period in which the charging roller 421 is brand-new, image unevenness caused by the effect of the external additive non-uniformly deposited on the charging roller 421 more significantly occurs. Therefore, if the external additive coating process is executed before the first image formation is performed after the toner installing process is performed, the effect of preventing deterioration in image quality becomes more prominent.

Second Embodiment

Next, an image forming apparatus 10A according to the second embodiment will be described with reference to FIGS. 4 to 7. The image forming apparatus 10A is different from the image forming apparatus 10 in the step involved with the primary transfer portion 45 in the toner installing process.

Figure 4:
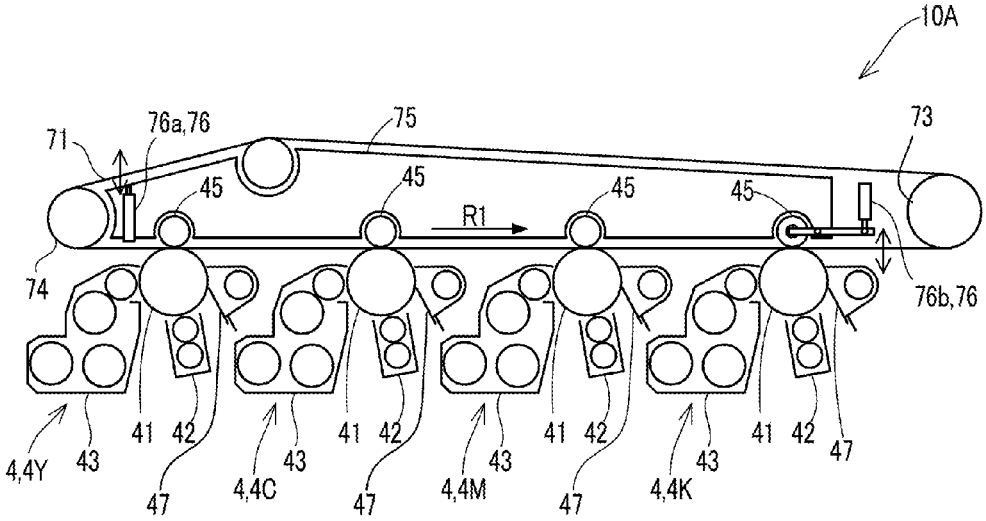
FIG. 4 is a view illustrating the configuration of an image forming portion in a first state in an image forming apparatus according to a second embodiment.
Figure 5:
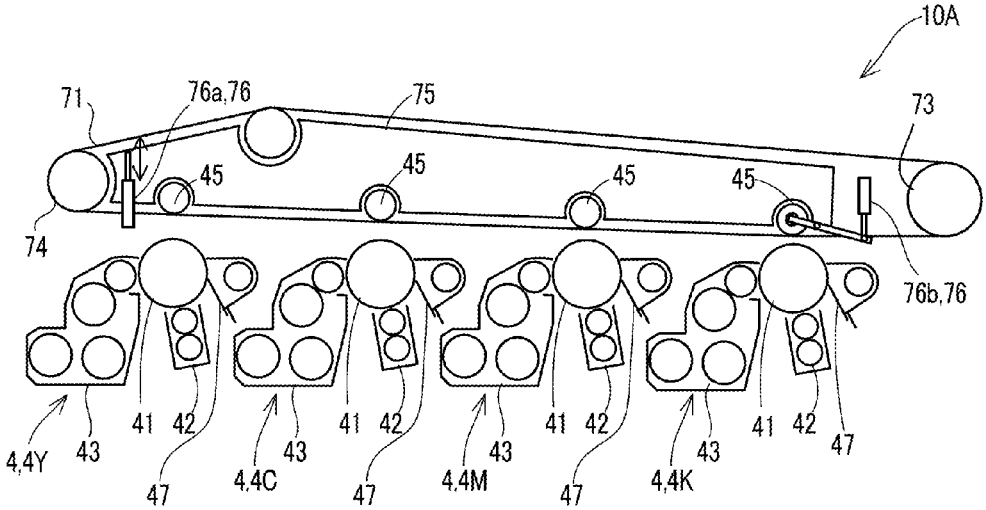
FIG. 5 is a view illustrating the configuration of an image forming portion in a second state in the image forming apparatus according to the second embodiment.
Figure 6:
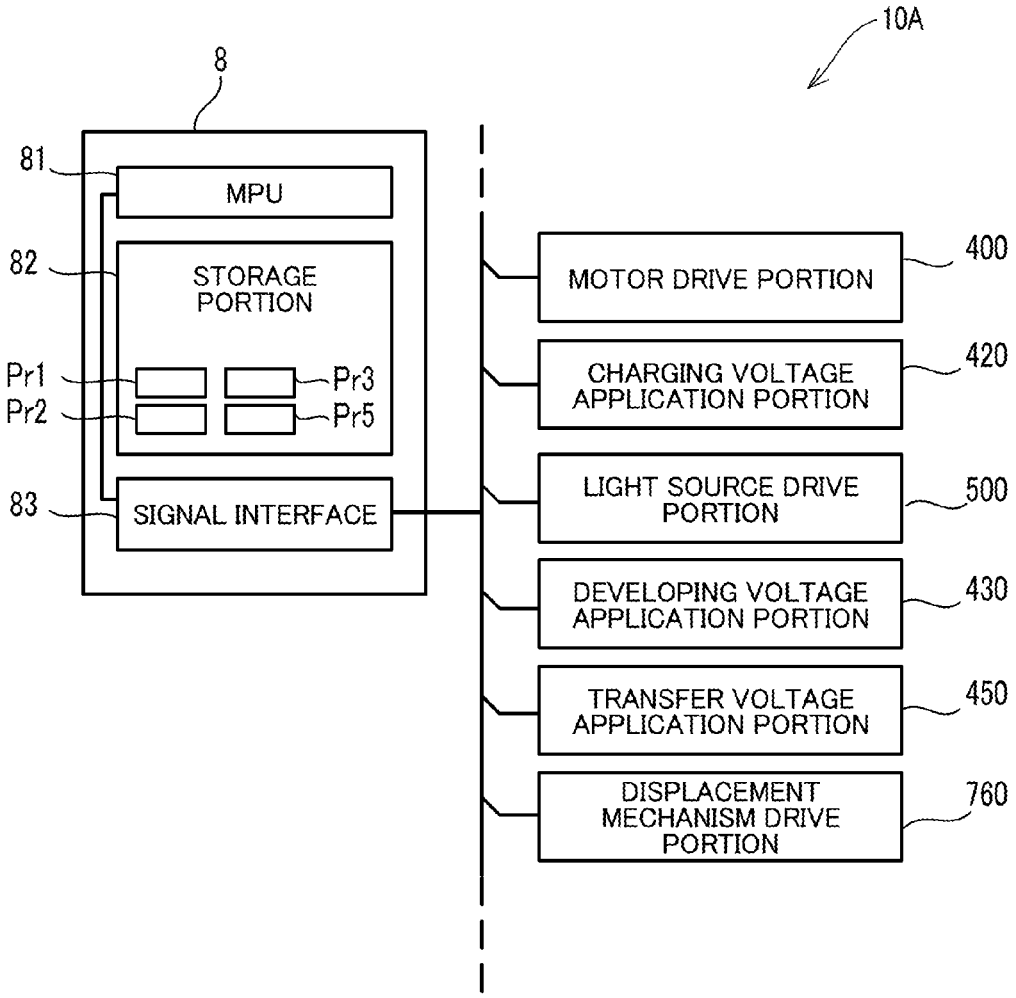
FIG. 6 is a block diagram illustrating control-related portions in the image forming apparatus according to the second embodiment.
Figure 7:
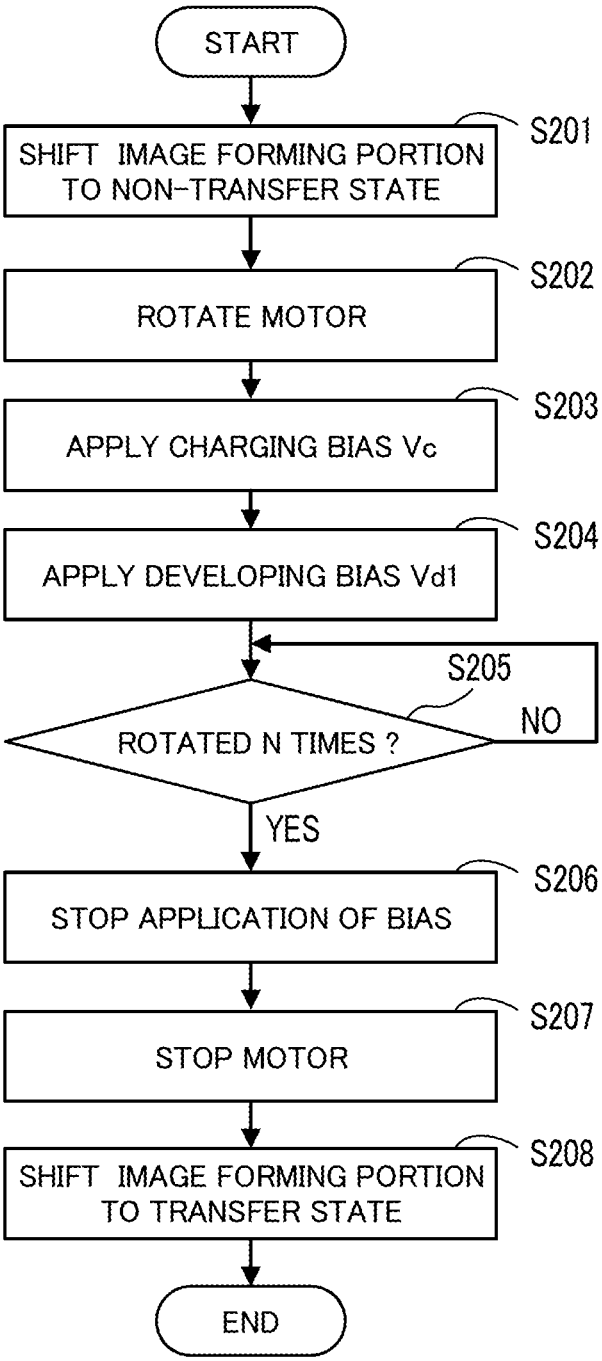
FIG. 7 is a flowchart illustrating one example of a procedure of an external additive coating process in the image forming apparatus according to the second embodiment.

FIG. 4 is a view illustrating the configuration of an image forming portion 4 in a first state in the image forming apparatus 10A. FIG. 5 is a view illustrating the configuration of the image forming portion 4 in a second state in the image forming apparatus 10A. FIG. 6 is a block diagram of control-related portions of the image forming apparatus 10A. FIG. 7 is a flowchart illustrating one example of a procedure of the external additive coating process in the image forming apparatus 10A.

Figure 3:
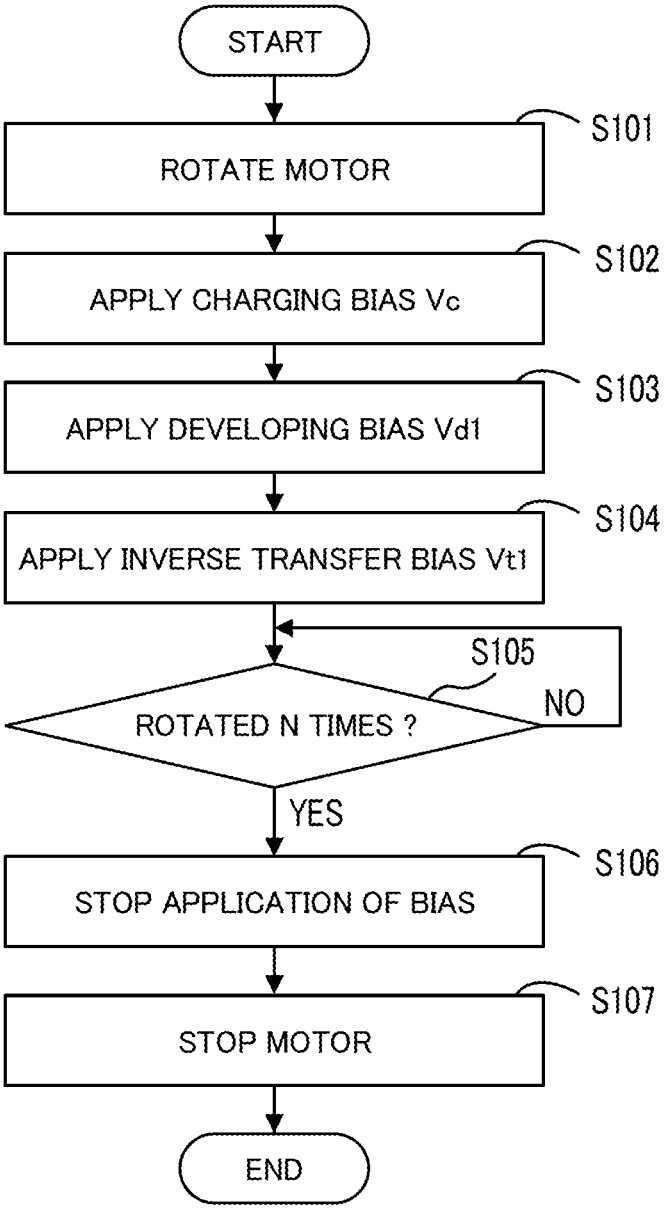
FIG. 3 is a flowchart illustrating one example of a procedure of an external additive coating process in the image forming apparatus according to the first embodiment.

In FIGS. 4 to 7, the same elements as the elements illustrated in FIGS. 1 to 3 are identified by the same reference numerals. Hereinafter, the aspect of the image forming apparatus 10A different from the image forming apparatus 10 will be described.

[Transfer Portion Displacement Mechanism 76]

The image forming apparatus 10A has a configuration formed by adding a transfer portion displacement mechanism 76 to the image forming apparatus 10. The transfer portion displacement mechanism 76 is a mechanism that separates the primary transfer portion 45 from the photosensitive member 41.

As illustrated in FIGS. 4 and 5, the transfer portion displacement mechanism 76 according to the present embodiment includes a first displacement mechanism 76*a* and a second displacement mechanism 76*b*.

The first displacement mechanism 76*a* rotates a support frame 75, which supports the second support roller 74 and primary transfer portions 45 of all of the image forming portions 4, around the primary transfer portion 45 of the black image forming portion 4K. According to this, the first displacement mechanism 76*a* changes the positional relation between the intermediate transfer belt 71 and the photosensitive member 41.

The first displacement mechanism 76*a* can selectively switche the states of the plurality of image forming portions 4 between a color mode state and a monochrome mode state in accordance with the change in the positional relation. FIG. 4 illustrates the image forming portion 4 in the color mode state.

The color mode state indicates that the primary transfer portions 45 of the image forming portions 4 of all colors are close to the photosensitive member 41. The color mode state also indicates that the photosensitive members 41 in the image forming portions 4 of all colors are in contact with the intermediate transfer belt 71.

On the other hand, the monochrome mode state indicates that the primary transfer portion 45 in only the black image forming portion 4K located at the most downstream side in the rotation direction R1 of the intermediate transfer belt 71 is close to the photosensitive member 41, and the primary transfer portions 45 in the image forming portions 4 of other colors are separated from the photosensitive member 41. The monochrome mode state also indicates that photosensitive member 41 in only the black image forming portion 4K is in contact with the intermediate transfer belt 71, and the photosensitive members 41 in the image forming portions 4 of other colors are separated from the intermediate transfer belt 71.

The second displacement mechanism 76*b* displaces the primary transfer portion 45 in the black image forming portion 4K between the position where the primary transfer portion 45 is close to the photosensitive member 41 in the black image forming portion 4K and the position where the primary transfer portion 45 is separated from the photosensitive member 41 due to the displacement of the portion of the support frame 75 supporting the primary transfer portion 45 in the black image forming portion 4K.

The first displacement mechanism 76*a* and the second displacement mechanism 76*b* are configured by a solenoid actuator and a link mechanism, for example.

In the present embodiment, the first displacement mechanism 76*a* can hold the support frame 75 at the position of the monochrome mode, and the second displacement mechanism 76*b* can hold the primary transfer portion 45 in the black image forming portion 4K at the position separated from the photosensitive member 41. Thus, the primary transfer portions 45 in the image forming portions 4 of all colors can be separated from the photosensitive member 41.

In the description below, the state in which the first displacement mechanism 76*a* holds the image forming portions 4 in the color mode state or the monochrome mode state and the second displacement mechanism 76*b* holds the primary transfer portion 45 in the black image forming portion 4K at the positon close to the photosensitive member 41 is referred to as a transfer state.

On the other hand, the state in which the first displacement mechanism 76*a* holds the image forming portions 4 in the monochrome mode state and the second displacement mechanism 76*b* holds the primary transfer portion 45 in the black image forming portion 4K at the position separated from the photosensitive member 41 is referred to as a non-transfer state. FIG. 5 illustrates the image forming portion 4 in the non-transfer state.

[Displacement Mechanism Drive Portion 760]

As illustrated in FIG. 6, the image forming apparatus 10A includes a displacement mechanism drive portion 760 that activates an actuator of the transfer portion displacement mechanism 76. The displacement mechanism drive portion 760 activates the actuator of the transfer portion displacement mechanism 76 according to the control signal from the control portion 8, thereby changing the state of the image forming portion 4 to the transfer state or the non-transfer state. Notably, the transfer state includes the color mode state and the monochrome mode state.

Further, the storage portion 82 of the image forming apparatus 10A previously stores the motor control program Pr1, the charging voltage control program Pr2, the developing voltage control program Pr3, and a displacement mechanism control program Pr5, as the program executed during the external additive coating process. With the execution of the displacement mechanism control program Pr5 by the MPU 81, the control of the displacement mechanism drive portion 760 by the control portion 8 is implemented.

External Additive Coating Process (Second Embodiment)

Next, one example of a procedure of the external additive coating process executed by the control portion 8 in the image forming apparatus 10A will be described with reference to the flowchart shown in FIG. 7. In the description below, S201, S202 . . . , each indicate an identification reference symbol for each step executed by the control portion 8.

<Step S201>

During the external additive coating process according to the present embodiment, the control portion 8 shifts the state of the image forming portion 4 to the non-transfer state through the displacement mechanism drive portion 760. According to this, the image forming portion 4 is held in the non-transfer state until the process in step S208 described below is executed.

<Step S202>

Further, the control portion 8 rotates the motor through the motor drive portion 400 as in step S101 in FIG. 3. According to this, the photosensitive member 41, the charging roller 421, the developing roller 431, the intermediate transfer belt 71, and the primary transfer roller 451 rotate.

<Steps S203, S204>

Further, the control portion 8 applies the charging bias voltage Vc to the charging roller 421 through the charging voltage application portion 420 (S203), and applies the developing bias voltage Vd1 including an AC component to the developing roller 431 in the developing portion 43 through the developing voltage application portion 430 (S204), as in steps S102 and S103 in FIG. 3.

It is to be noted that, in the present embodiment, the primary transfer portion 45 is held to be separated from the photosensitive member 41, instead of the inverse transfer bias voltage Vt1 being applied to the primary transfer roller 451 in the primary transfer portion 45.

With the processes described above, the external additive is deposited onto the surface of the photosensitive member 41 at the positon where the photosensitive member 41 and the developing roller 431 face each other, whereby a uniform layer of the external additive is formed on the surface of the photosensitive member 41 along the direction of the rotation axis of the photosensitive member 41.

<Step S205>

The control portion 8 continues to hold the non-transfer state of the image forming portion 4, hold the rotation state with no image of the photosensitive member 41, and apply the charging bias voltage Vc and the developing bias voltage Vd1, until the photosensitive member 41 rotates a predetermined number of times.

<Step S206>

After the photosensitive member 41 rotates the predetermined number of times, the control portion 8 stops application of the charging bias voltage Vc and the developing bias voltage Vd1.

<Step S207>

Further, the control portion 8 stops the motor through the motor drive portion 400. According to this, the rotations of the photosensitive member 41, the charging roller 421, the developing roller 431, the intermediate transfer belt 71, and the primary transfer roller 451 are stopped.

<Step S208>

Further, the control portion 8 returns the state of the image forming portion 4 to the transfer state through the displacement mechanism drive portion 760. Thus, the external additive coating process is ended.

The similar effect as in the case where the image forming apparatus 10 is used can be obtained also in the case where the image forming apparatus 10A is used.

In addition, in the image forming apparatus 10A, the transfer portion displacement mechanism 76 holds the primary transfer portion 45 at the position separated from the photosensitive member 41, when the photosensitive member 41 is in the rotation state with no image and the developing bias voltage Vd1 is applied to the developing roller 431 (S201 to S204).

Therefore, the transfer of the external additive deposited onto the photosensitive member 41 to the intermediate transfer belt 71 can reliably be prevented in the external additive coating process.

Application Example

In the embodiments described above, it is also conceivable that the developing bias voltage Vd1 in the external additive coating process is equal to the reference developing bias voltage Vd0 at the time of the image formation.

It is also conceivable that a bias voltage is not applied to the primary transfer portion 45 in the external additive coating process according to the first embodiment.

It is also conceivable that, in the case where the external additive coating process is performed for the image forming portions 4 other than the black image forming portion 4K in the second embodiment, the transfer portion displacement mechanism 76 holds the image forming portions 4 in the monochrome mode state.

It is also conceivable that the image forming apparatuses 10 and 10A are a monochrome image forming apparatus including one image forming portion 4. In this case, a transfer portion corresponding to the primary transfer portion 45 may directly transfer an image of toner 90 on the surface of the photosensitive member 41 to the sheet material 9 which is one example of the transfer target member.

It is to be noted that the image forming apparatus according to the present disclosure can be configured by freely combining the embodiments and the application example described above or modifying or partly omitting the embodiments and the application example as appropriate within the scope of the invention described in each claim.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a charging roller that is in contact with a rotating image carrier to charge the image carrier;

a developing voltage application portion configured to apply a developing bias voltage including an AC component to a developing roller in a developing portion, which supplies toner containing an external additive to the image carrier, when the charged image carrier is in a rotation state with no image in which the image carrier rotates with no electrostatic latent image being formed thereon, before a first image formation is performed and after the toner is supplied to the developing portion from a toner supply portion; and a transfer voltage application portion configured to apply a voltage having a polarity opposite to that of a voltage applied to transfer an image of the toner to a transfer portion which transfers the image of the toner carried by the image carrier to a transfer target member during image formation, when the image carrier is in the rotation state with no image and the developing bias voltage is applied to the developing roller.

2. The image forming apparatus according to claim 1, wherein the developing voltage application portion applies the bias voltage to the developing roller when the image carrier is in the rotation state with no image before the first image formation is performed and after a toner installing process of supplying the toner to the developing portion is executed by a toner supply portion, the toner installing process being executed before the first image formation is performed or when the developing portion is exchanged.

3. The image forming apparatus according to claim 2, wherein the developing bias voltage has a peak-to-peak value larger than that of the developing bias voltage applied to the developing roller during image formation.

* * * * *